United States Patent [19]

Morgan

[11] 4,227,985

[45] Oct. 14, 1980

[54] ANODE ASSEMBLY

[75] Inventor: John H. Morgan, Winchester, England

[73] Assignee: Morgan Berkeley & Company Ltd., Winchester, England

[21] Appl. No.: 14,328

[22] Filed: Feb. 22, 1979

[51] Int. Cl.[2] ..... C23F 13/00

[52] U.S. Cl. ..... 204/196

[58] Field of Search ..... 204/147, 148, 196, 197

[56] References Cited

U.S. PATENT DOCUMENTS 3,994,794 11/1976 Bohne ..... 204/197

3,994,795 11/1976 Kurr ..... 204/197

FOREIGN PATENT DOCUMENTS 927232 5/1963 United Kingdom ..... 204/196

OTHER PUBLICATIONS

"Cathodic Protection of Submarine Pipelines", Reprinted from Federated Metals Digest, ASARCO, 1958, pp. 1 & 2.

*Primary Examiner*—G. L. Kaplan

*Attorney, Agent, or Firm*—Kenyon & Kenyon

[57] ABSTRACT

An anode assembly for use in a system for the cathodic protection of a submerged, or partly submerged elongate metallic member the assembly being adapted to be fixed to and to encircle a length of said member. The assembly includes a plurality of generally flat, elongate electrically insulating panels of which at least one accommodates a metallic element which will constitute an anode in the aforesaid system, and a cable for providing electrical connection to the metallic element, the panels being adapted to be interconnected, in use of the assembly, and circumferentially disposed around the elongate member with part of the surface of the metallic element exposed outwardly of the elongate member. When so interconnected, the panels form a space between the assembly and the elongate member, and the assembly is apertured to permit electrical current to flow into this space to the elongate member from the metallic element when operating as an anode in the system.

7 Claims, 3 Drawing Figures

ANODE ASSEMBLY

FIELD OF THE INVENTION

The invention relates to an anode assembly for use in a system for the cathodic protection of a metallic structure disposed at least partly in a liquid in which it is liable to corrosion by electrolyte action. The anode assembly of the invention is particularly but not exclusively intended to be mounted on an elongate ferrous member such as a pile or leg of a jetty, pier, or of an offshore structure such as an oil rig, and to form part of an impressed current system for the cathodic protection of the submerged portion of such element.

BACKGROUND TO THE INVENTION

It has been proposed in the past to provide, as a mounting arrangement for one or more such anodes, an elongate sleeve or collar-like structure adapted to be clamped in a close-fitting manner about the pile, the anodes, of elongate form being accommodated in recesses in such mounting collar so as to extend substantially parallel to the pile axis when mounted thereon. The mounting collar is constructed of electrically insulating material to constitute a shield providing the required insulation of the anode, or anodes from the adjacent pile metal both electrically and electrolytically to avoid an electrical short circuit, and over-protection which can result in an electrolyte "short circuit" current.

It is necessary or at least desirable with such a close-fitting insulating shield to provide for the flow of protective current to the pile surface beneath the shield to ensure that this part of the pile is protected. It is furthermore desirable to provide a shield which can be mounted on piles, legs or other elongate members of circular section, but which is of such construction as to avoid the requirement for manufacture to a precise dimensional specification determined by the diameter of the member.

SUMMARY OF THE INVENTION

According to the present invention, there is provided an anode assembly for use in a system for the cathodic protection of a submerged, or partly submerged elongate metallic member, the assembly being adapted to be fixed to and to encircle a length of said member and including a plurality of generally flat, elongate electrically insulating panels of which at least one accommodates a metallic element, means for providing electrical connection to said metallic element, said panels being adapted to be interconnected, in use of the assembly, and circumferentially disposed around the elongate member with part of the surface of the metallic element exposed outwardly of the elongate member, and to form a space between the assembly and said elongate member, the assembly being apertured to permit electrical current to flow through said space to the elongate member from said metallic element operating as an anode in the said system.

The assembly preferably comprises two or more parts adapted to be fixed together to encircle a length of the elongate member, each part having a plurality of interconnected panels of which one includes a said metallic element.

The panels preferably abut or adjoin along elongate edges thereof, said edges extending parallel to the axis of the elongate member when in use, a clamping arrangement for the two parts permitting the two parts to be clamped together to fix the assembly on the member with the rear surfaces of the panels engaging the outer surface of the member.

The panels are preferably moulded in reinforced glass fibre upon steel wire framework which, in the constructed assembly forms a plurality of polygonal frames axially spaced along, and encircling the elongate member.

BRIEF DESCRIPTION OF THE DRAWINGS

An embodiment of the invention will now be described by way of example, with reference to the accompanying drawings, in which.

DETAILED DESCRIPTION OF THE PARTICULAR EMBODIMENT

Figure 2:
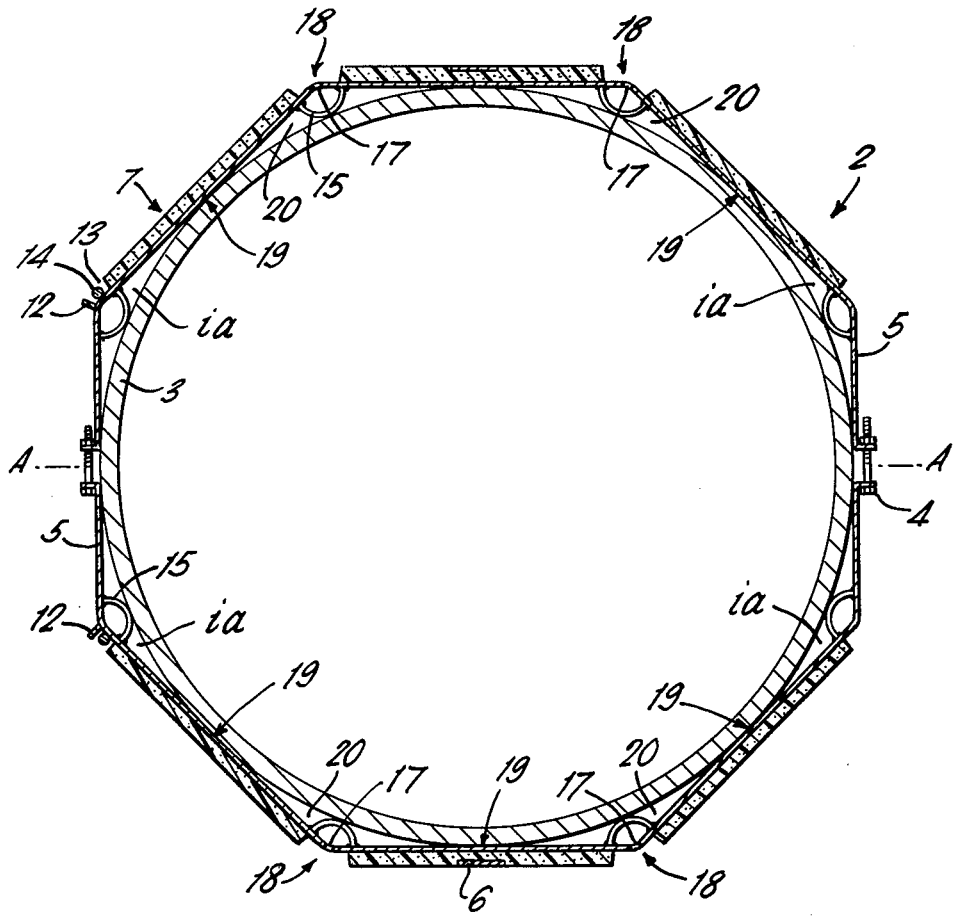
FIG. 2 is a section through the pile and anode assembly taken on line II—II of FIG. 1.

The anode assembly illustrated comprises a plurality, in this case six, of elongate flat panels 1 arranged to form a collar or shield 2 adapted to be fixed to and encircle a portion of a cylindrical steel pile 3. The shield 2 is of substantially regular polygonal configuration in section, as seen in FIG. 2, and is formed in two parts, each having three panels 1 in the present embodiment, these parts being clamped together at diametrically opposite points of the sectional polygon by respective clamping assemblies 4 to tighten the anode assembly on the pile. The illustrated anode assembly forms an octagon in section, the panels 1 forming two sets of three adjacent sides of the octagon, the sets being disposed symmetrically about the diameter A—A passing through the clamping assemblies 4.

The panels 1 of each part of the assembly are moulded in reinforced glass fibre onto a plurality of rigid half-frames 5 of heavy gauge steel wire construction, forming, in the final assembly a plurality of axially spaced polygonal (in this case octagonal) wire frames to support the panels 1 on the pile.

Figure 3:
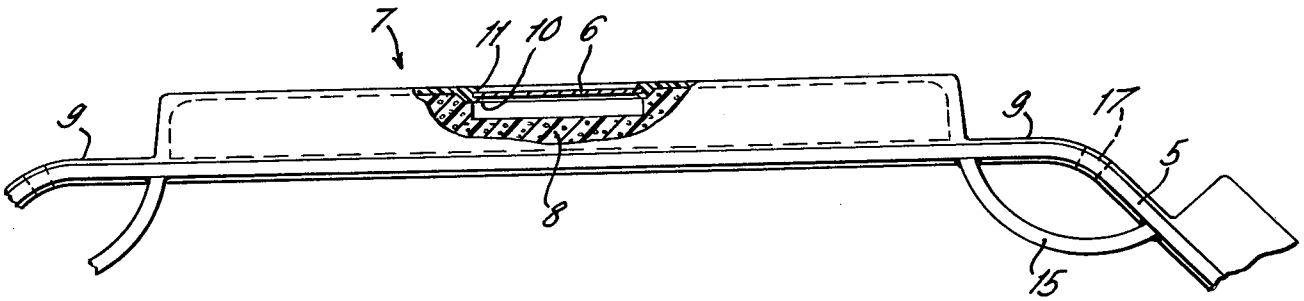
FIG. 3 is an end view, partly broken to illustrate an anode, of part of the anode assembly shown in FIG. 1.

The two central panels 1 of the panel sets serve to mount respective elongate anodes 6, the constructional details of these particular panels being illustrated in FIG. 3. A central portion 7 of the panel, extending over a substantial part of the width thereof, projects outwardly and is formed from the reinforced glass fibre as a shell containing a rigid foam core 8. The two elongate side edge portions 9 of the panel extend to two adjacent apices of the respective steel half-frame 5 to abut the corresponding side portions of the two outer panels of the respective panel set. The anode 6 is held in an elongate recess 10 in the outer surface of the central panel portion 7, its edges being held by a peripheral lip 11 of the glass fibre material. FIG. 3 illustrates the comparative thicknesses of anodes of titanium (illustrated in full line) and of silver/lead alloy (in chain line) and the comparative depths of the associated recesses in order to ensure that the exposed anode surface lies beneath the plane of the outer surface of portion 7. The foam construction of core 8 is suitable where the anode assembly is to be used at a comparatively shallow level beneath the water surface. At greater depths a core of denser solid material is appropriate.

The side panels on each side of the central panel are of a similar construction except for the absence of an anode 6 and corresponding recess 10. However, one of the side panels of each panel set is formed with an elongate longitudinally extending rib 12 which projects outwardly at an apex from that elongate side portion 9 which is isolated. This rib 12 defines, with a side wall of the central panel portion 7 a channel 13 which accommodates a respective anode cable 14. This cable extends axially of the pile along the channel 13 and at an intermediate point along the channel passes behind the panel and extends circumferentially (as shown in dotted lines at 14*a*) to the position of the anode in the adjacent panel. There it projects into the central portion 7, through the foam core 8 and is electrically connected to the rear concealed surface of the anode. This cable extends from the anode assembly along the pile 2 and carries current from a source (not shown) remote from the anode assembly to the anode where it passes into the water as the cathodic protective current.

At the apices of each half-frame 5 are provided respective inwardly projecting spacer elements in the form of arcuate wire stand-offs 15 which avoid undue bending of the panels 1 during tightening of the clamping assemblies 4 by maintaining the apices spaced radially from the pile surface. The wire construction of these stand-offs 15 provides a degree of flexibility of the half-frames to allow variation of the internal angles at the apices whereby an anode assembly may be fitted to piles having a range of diameters, the stand-off profile varying to suit the particular pile diameter concerned.

In order to ensure that sufficient but not excessive, protective current can flow to the pile surface behind the anode shield, apertures 17 are cut in the panels, these apertures being of predetermined size and spacing, and positioned at or close to the apex lines 18 at the edges of the central panel. It will be appreciated that since the two opposite sides of the generally octagonal assembly at which clamping assemblies 4 are disposed are not provided with panels in this embodiment, current $i_a$ can flow round the isolated edges of the side panels, as shown in FIG. 2, but the engagement of the rear of such panels with the cylindrical pile surface at elongate regions 19 prevents passage of this current to the two elongate, substantially triangular section spaces 20 behind the two apex lines 18. The entry of current into these spaces from the ends of the assembly is inhibited by the presence of the steel stand-offs 15 which present preferential conductive paths direct to the pile, and accordingly, the apertures 17 must therefore carry all, or substantially all of the current required to protect the parts of the pile surface between regions 19.

It is possible to calculate the spacing and the pitch of these apertures so that complete and adequate protection is given under a variety of operating conditions of the anodes.

The current density, in terms of amps per unit area of the pile surface, necessary to provide full protection will be known for the particular conditions and properties of the water surrounding the pile. The pile surface area behind the apex lines 18 is calculated and the range of current which can flow into the spaces 20 to provide sufficient, but not over-protection is determined from these values for current density and area. The calculations of spread of current from the apex into the narrowest gap between the shield and the pile are known. The current flowing through a circular aperture of diameter a is given by the formula:

$$I = V \times a/p$$

where p is the resistively in ohms cm and a is in cms.

The driving voltage that will drive the current through the hole is calculated from the output and location and shape of the anode on the outside of the shield. These formulae are well known for the calculation of this current.

It would appear typically that an aperture of 1 cm diameter in seawater of 25 ohms cm resistivity would allow a current of $\frac{1}{8}$ of an amp to flow if there is a 3V driving potential from the anode at the aperture. This current of $\frac{1}{8}$ of an amp would be sufficient to protect 2 $m^2$ of bare steel pile surface without causing excessive over-protection. Also should the current output of the anode be reduced to one-tenth of that which produced the 3 V driving then sufficient current would still be given out to prevent corrosion. Two apertures each $\frac{1}{2}$ cm in diameter would provide the same current as the single aperture of 1 cm diameter.

In this way, the required number, size, and spacing of the apertures is determined.

Figure 1:
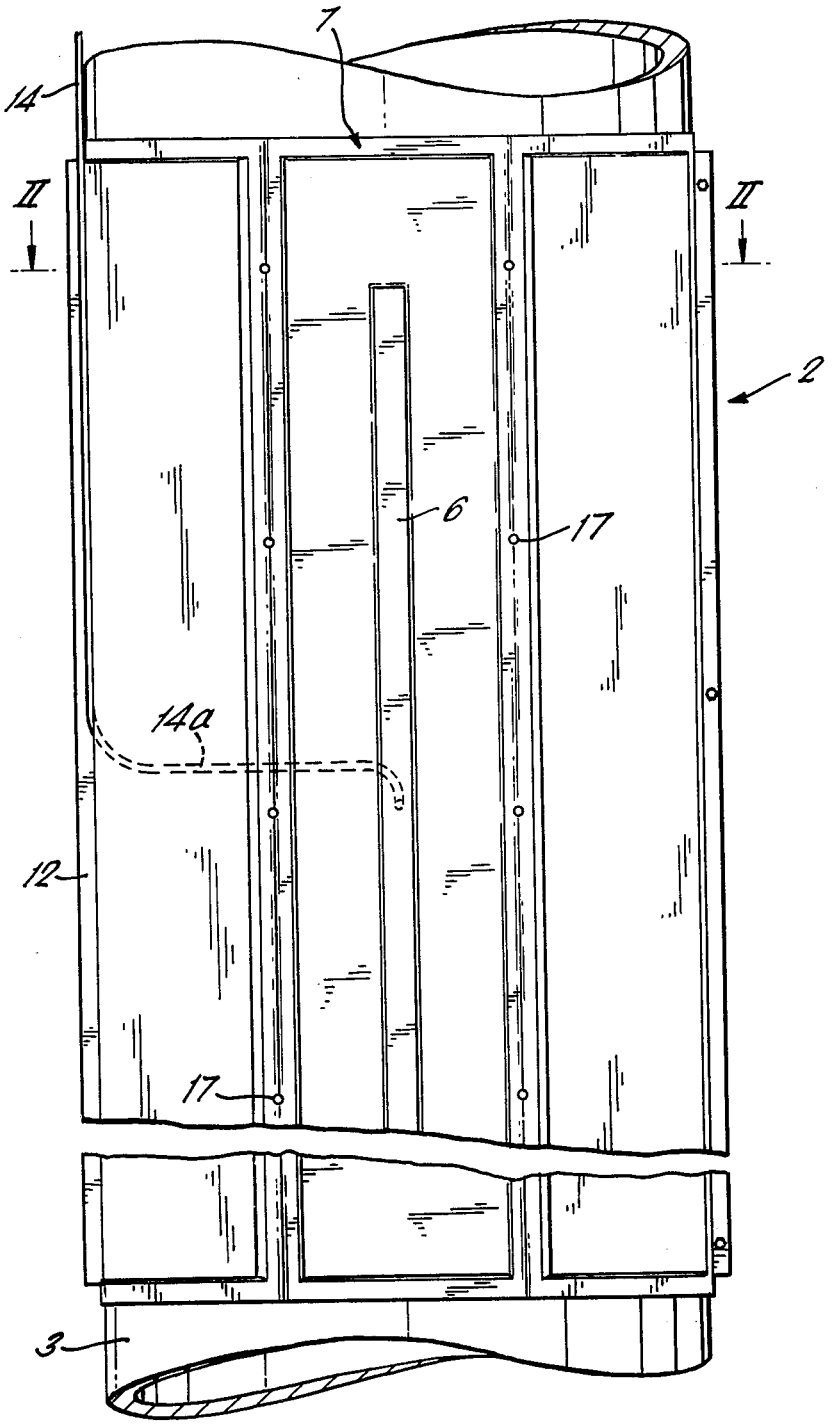
FIG. 1 is a side view of a cylindrical steel pile upon which is mounted an anode assembly according to the invention.

In FIG. 1, which illustrates the assembly as seen in the direction of arrow B of FIG. 2, only one of the two parts can be seen and accordingly only two of the four sets of apertures 17 provided in this particular embodiment are visible, the remaining two sets being in the other part disposed on the other side of the pile 3. Thus, the apertures 17 are cut wherever an apex extends over a space which is otherwise substantially electrically isolated from the surrounding water.

I claim:

1. An anode assembly for use in a system for the cathodic protection of a submerged, or partly submerged elongate metallic member, the assembly comprising two or more parts adapted to be fixed together to encircle a length of the elongate member, each part having a plurality of interconnected, generally flat, elongate electrically insulating panels of which at least one accommodates a metallic element, means for providing electrical connection to said metallic elements, the arrangement being such that, in use of the assembly, with said parts fixed together as aforesaid, the panels are circumferentially disposed around the elongate member with a part of the surface of each metallic element exposed outwardly of the elongate member, and with a space formed between the assembly and said elongate member, the assembly being apertured to permit electrical current to flow through said space to the elongate member from said metallic elements operating as anodes in the said system.

2. An assembly according to claim 1 wherein the panels of each part abut or adjoin along elongate edges thereof, said edges extending parallel to the axis of the elongate member when in use, a clamping arrangement for the two parts permitting the two parts to be clamped together to fix the assembly on the member with the rear surfaces of the panels engaging the outer surface of the member.

3. An assembly according to claim 1 or claim 2 wherein the panels of each said part are carried on and interconnected by a sub-frame, said sub-frames being adapted to be clamped together to construct the assembly.

4. An assembly according to claim 3 wherein said sub-frames are adapted to form, in the constructed assembly, a framework consisting of a plurality of polygonal frames axially spaced along and encircling the elongate member.

5. An assembly according to claim 4 wherein said sub-frames are adapted to provide, at the corners of said polygonal frames, inwardly projecting spacer elements to engage the outer surface of said member.

6. An assembly according to claim 3 wherein said panels comprise plastics material rigidly attached to said sub-frames.

7. An assembly according to claim 1 and which is apertured by at least one of said panels including a plurality of apertures spaced longitudinally of the panel in a portion thereof which, in use of the assembly partly defines said space.

* * * * *